United States Patent [19]

Brown et al.

[11] Patent Number: 4,568,290

[45] Date of Patent: Feb. 4, 1986

[54] LATERAL THRUST DRIVE FOR WATERCRAFT

[76] Inventors: George L. Brown, 419 "N" St., Benicia, Calif. 94510; Paul Hales, Spindrift at Norman's Bay near Pevensey, East Sussex, England, BN216PU

[21] Appl. No.: 595,749

[22] Filed: Apr. 2, 1984

[51] Int. Cl.[4] ..... B63H 1/30

[52] U.S. Cl. ..... 440/13

[58] Field of Search ..... 440/13, 17–20, 440/21, 24–32, 14–16

[56] References Cited

U.S. PATENT DOCUMENTS 2,875,723 3/1959 Moore ..... 440/20

3,110,283 11/1963 Warner ..... 440/15

FOREIGN PATENT DOCUMENTS 890762 9/1953 Fed. Rep. of Germany ..... 440/14

961498 5/1950 France ..... 440/20

*Primary Examiner*—Trygve M. Blix

*Assistant Examiner*—Jesûs D. Sotelo

*Attorney, Agent, or Firm*—Harris Zimmerman; Howard Cohen

[57] ABSTRACT

A lateral thrust drive apparatus for watercraft includes a pair of panel-like blades joined to a respective pair of arms in limited rotational fashion. The arms extend to a pair of parallel drive shafts which extend from a drive housing. Within the housing, a gear assembly drives the shafts in equal and opposite angular excursions, so that the blades diverge and converge in reciprocal fashion. The housing may be removably secured to the stern of a watercraft, and a handle extending from the housing and secured to the gear assembly may be pumped reciprocally to drive the blades and thus propel the craft.

9 Claims, 9 Drawing Figures

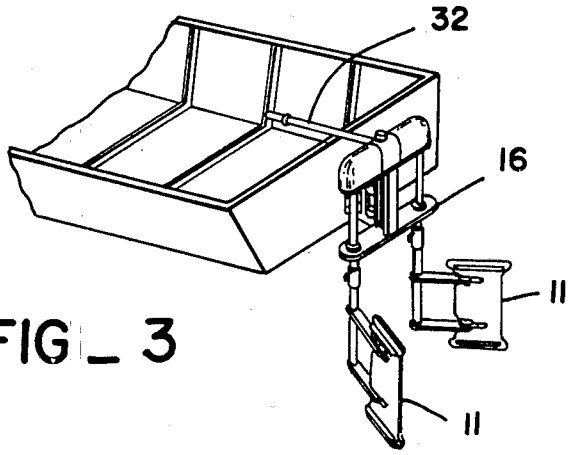
FIG_3
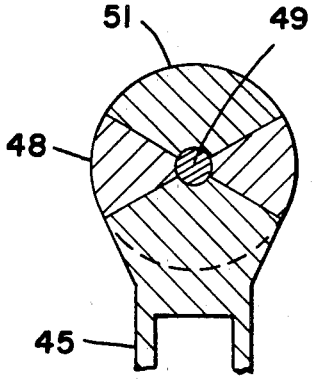
FIG_4
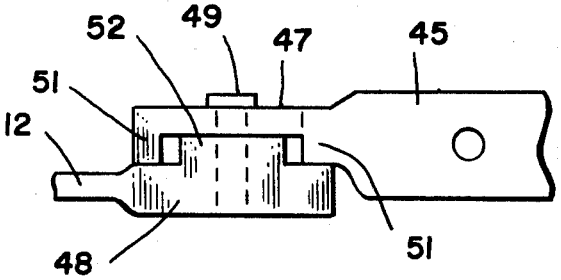
FIG_5
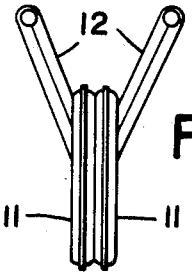
FIG_6
FIG_7
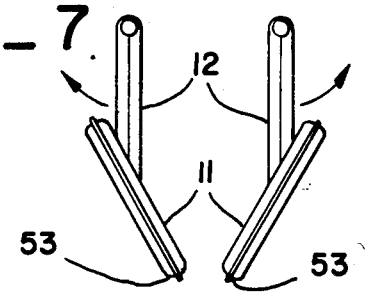
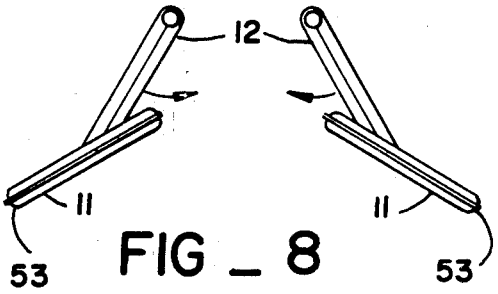
FIG_8
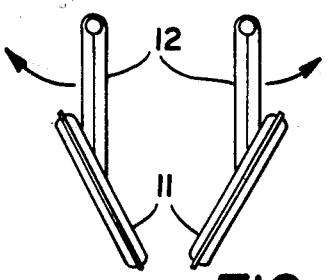
FIG_9

LATERAL THRUST DRIVE FOR WATERCRAFT

BACKGROUND OF THE INVENTION

In any endeavor which involves the use of watercraft, the loss of the craft's propulsion is a most frustrating, if not frightening, prospect. This is a rather common occurrence, considering powered pleasure boats which run out of fuel, sailboats which are becalmed, and motor-powered commercial boats which experience engine failure. When any of these problems occur, it is necessary either to request assistance of the Coast Guard or a passing vessel, or to attempt to propel the craft manually.

The latter possibility is fraught with difficulties, due to the fact that most vessels are not designed to be paddled. When the beam of the vessel, or the freeboard, is beyond a minimal dimension, the use of a paddle requires a great deal of effort to achieve a very small forward velocity. Furthermore, propelling the boat in the desired direction may be extremely difficult, especially if the boat relies on a steerable outboard drive for directional control. As a result, assistance is usually required, as attested to by the fact that the Coast Guard is regularly inundated with SOS calls on any fair weather weekend. Clearly there is a need, unfilled in the prior art, for a manual watercraft propulsion system which is effective and practical.

SUMMARY OF THE PRESENT INVENTION

The present invention generally comprises a lateral thrust drive apparatus for propelling watercraft. A salient feature of the invention is that it may be used effectively as an auxiliary propulsion system in the event of failure of the vessel's main propulsion system, whether it is driven by motor or sail. The apparatus may be disassembled and stowed when not in use, and quickly reassembled and secured to the stern of the vessel when needed.

The lateral thrust drive apparatus for watercraft includes a pair of panel-like blades, each joined to a pair of arms with limited rotational motion therebetween. The arms extend to a pair of parallel drive shafts which extend downwardly from a drive housing. Within the housing, a bevel gear assembly drives the shafts in equal and opposite angular excursions, so that the blades diverge and converge in reciprocal fashion. The housing may be removably secured to the stern of a watercraft by means of a pivoting bracket assembly, and a handle extending from the housing and secured to the gear assembly may be pumped reciprocally to drive the blades and thus propel the craft. The pivotting bracket assembly permits selective variation in the angle of the thrust with respect to the vessel centerline, so that the craft may be steered as well as propelled by the apparatus.

BRIEF DESCRIPTION OF THE DRAWING

FIG. 3 is a perspective view of the apparatus of the present invention mounted on the stern of a small boat.

FIG. 4 is an enlarged top view of the junction of the blade and pivot arm of the present invention.

FIG. 5 is a side view of the junction depicted in FIG. 4.

FIGS. 6–9 are a sequence of views depicting the operation of the blades of the drive apparatus.

DESCRIPTION OF THE PREFERRED EMBODIMENT

Figure 1:
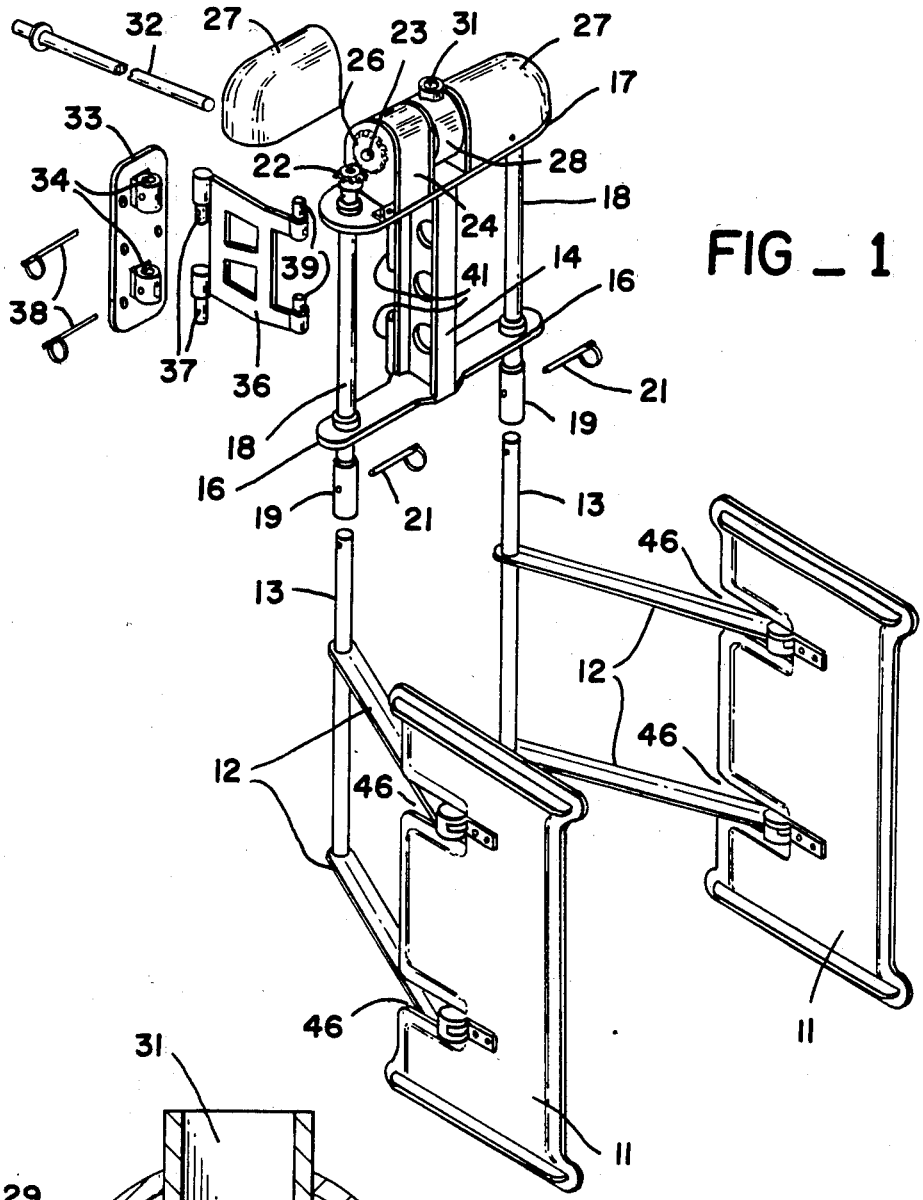
FIG. 1 is a partially exploded perspective view of the lateral thrust drive apparatus of the present invention.

The present invention generally comprises a lateral thrust drive apparatus for use in propelling a watercraft. With regard to FIG. 1, the preferred embodiment of the apparatus includes a pair of generally planar, panel-like blades 11 adapted to be disposed in the water. Each of the blades is joined to a pair of parallel pivot arms 12 in a manner which provides limited rotational motion therebetween, as will be explained in the following. Each pair of arms 12 extends generally orthogonally from one of a pair of lower drive shafts 13, which are disposed in vertical, parallel fashion.

The upper portion of the drive apparatus includes a main vertical support 14, and a yoke plate 16 secured at a medial portion thereof to the lower end of the vertical support 14. A base plate 17 is joined at a medial portion thereof to the upper end of the vertical support member, the plates 16 and 17 being disposed in generally horizontal, parallel fashion. A pair of upper drive shafts 18 extend through like opposed ends of the plates 16 and 17, and are journalled therein in generally parallel, vertical relationship. The lower ends of the shafts 18 are provided with sleeves 19 which receive the upper ends of the respective shafts 13. A pair of locking pins 21 extend removably through aligned holes in the sleeves and the shafts 13 to secure the latter in the former.

Joined to the upper end of the upper shafts 18 are a pair of bevel gears 22 for rotation in common therewith. Secured to the base plate 17 is a pair of journals 24 which support a horizontally disposed drive shaft 23. Secured to opposed ends of the shaft 23 are a pair of bevel gears 26 which are disposed to mesh with the respective gears 22. The gear ratio of the gears 26 and 22 is approximately 2:1, so that the shaft assemblies 18 and 13 undergo an angular excursion twice that of the shaft 23. A pair of cover members 27 extend over the gears 22 and 26 and are secured to the base plate.

Figure 2:
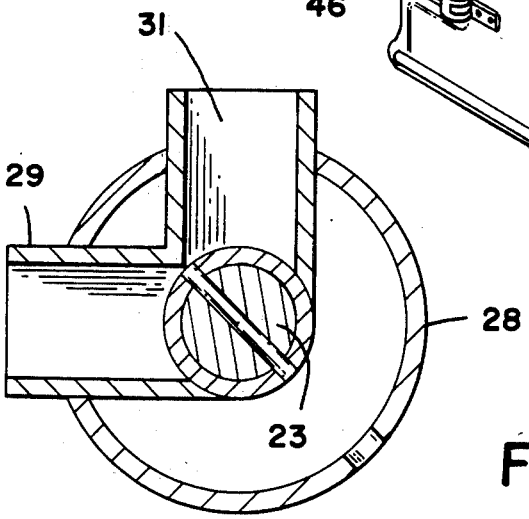
FIG. 2 is a cross-sectional view of the handle socket assembly of the drive apparatus.

The drive shaft 23 is provided with an outer sleeve member 28 secured to a medial portion thereof. With reference to FIG. 2, a pair of cylindrical socket members 29 and 31 are secured to the shaft 23, and extend outwardly therefrom in a generally mutually orthogonal relationship. The socket members extend through aligned holes in the sleeve member 28. The socket members are dimensioned to receive a long, cylindrical operating handle 32.

The invention also includes a mounting bracket 33 which is adapted to be permanently secured to the transom of a boat, or to a like stern portion. The bracket includes upwardly opening cylindrical mounting holes 34 disposed in vertical alignment. A standoff bracket 36 is also provided, including a pair of vertically aligned mounting pins 37 which are adapted to be removably received in the holes 34. A pair of locking pins are provided to extend through aligned holes in the mounting bosses and pins 37 to rotationally immobilize and secure the standoff bracket to the boat. The opposed edge of the standoff is provided with a vertically aligned pair of upwardly extending pins 39. The pins 39 are received in suitably dimensioned hinge members 41 extending from the vertical support 14, so that the drive apparatus is rotatable about the vertical axis defined by the pins 39.

With reference to FIGS. 1, 4, and 5, the blades 11 are provided with slots 46 formed in the leading edges thereof and extending approximately one-third of the width of each blade. At the inner end of each slot 46 there is secured to the blade a pivot bracket 45 which terminates at its proximal end in a disc-like portion 47. The distal end of each arm 12 terminates in a similar disc-like portion 48 which is axially aligned with the respective portion 47. A pivot pin 49 extends axially and secures the two portions 47 and 49 together in freely rotating fashion. The portions 47 and 49 include respective bosses 51 and 52 which extend axially therefrom and subtend predetermined angles about the circumferences of the respective members to limit the angular displacement therebetween. Thus the blades 11 which are secured to the brackets 45 are limited in their angular excursions with respect to the arms 12, yet are freely rotatable within these angular limits, which are approximately 30° in the preferred embodiment.

To operate the present invention in the forward propulsion mode, the handle is inserted in the receptacle 29 and raised approximately 30° from horizontal. The blades are thus disposed in parallel, impinging relationship, as depicted in FIG. 6. The boat operator then proceeds to pull the handle downwardly, rotating the shaft 23 and thus driving the shafts 13 to rotate and causing the blades to diverge, as shown in FIG. 7. Due to the fact that the pivot joining the each arm 12 and blade 11 is proximal with respect to the center of fluid resistance of the blade, the blades pivot so that their distal edges are closer than the proximate edges, and the blades diverge angularly. This angular orientation causes a forward thrust, while the outward thrust of the blades is balanced and neutralized.

At the furthest extend of the stroke, the handle attains a horizontal position, and the operator begins to raise the handle. As shown in FIG. 8, the force couple formed by the fluid resistance and the drive of the arms 12 causes the blade edges 51 to diverge as the blades begin to approach each other. This angular disposition again causes the displaced water to exert a forward thrust on the apparatus, and the outward thrust is neutralized. Thus pumping the handle reciprocally generates a forward thrust on both strokes, and the boat is driven forwardly. It should be noted that the handle is also employed to adjust the angle of the apparatus with respect to the bracket 36 and with the centerline of the boat, so that the thrust generated is directed to steer the watercraft.

The apparatus of the present invention can also be used to drive the boat in the reverse direction. The handle is inserted in the receptacle 31, and rotated to horizontal to disposed the blades in generally parallel alignment. With reference to FIG. 9, the handle is then pumped reciprocally as before to cause the blades to converge, generating a reverse thrust. As before, the boat may be steered by directing the reverse thrust.

It should be noted that although the invention has been described as a manual propulsion device, it could well be driven by a suitable engine arranged to drive the shaft 23 reciprocally.

It may be appreciated that the apparatus of the preferred embodiment may be fabricated of positive buoyancy members so that all portions of the apparatus will float, and may be retrieved if lost overboard. Furthermore, the apparatus easily may be assembled to the stern of the boat, as needed, or removed when not required. The short reciprocal motion of the blades, together with their lack of sharp edges, results in a safe propulsion arrangement which does not snag nets, lines, and weeds.

We claim:

1. A watercraft propulsion apparatus, comprising; a pair of panel-like blades, a pair of generally parallel pivot shafts, arm means for joining each of said shafts to one of said blades in generally parallel relationship, pivot means disposed between said arm means and each of said blades for permitting limited angular movement therebetween, means for driving said pivot shafts reciprocally in substantially equal, opposite angular excursions, including a drive shaft, and bevel gear means operably connecting the opposed ends of said driveshaft to said pair of pivot shafts, and means for securing said apparatus to a watercraft.

2. The apparatus of claim 1, further including a handle socket extending radially outwardly from a medial portion of said drive shaft.

3. The apparatus of claim 2, further including a longitudinally extending, tubular handle member adapted to be received in said handle socket to rotate said drive shaft.

4. The apparatus of claim 1, further including a pair of handle sockets extending radially outwardly from a medial portion of said drive shaft, said pair of sockets diverging angularly about the axis of said drive shaft.

5. The apparatus of claim 1, further including a yoke assembly for supporting said pivot shafts in said parallel disposition, and a vertical support member joined at one end to said yoke assembly.

6. The apparatus of claim 5, further including a base plate secured to the other end of said vertical support member, and journal means secured to said base plate for supporting said drive shaft.

7. The apparatus of claim 6, further including a standoff bracket removably secured to said vertical support member in pivoting fashion.

8. The apparatus of claim 7, further including a mounting bracket secured to said watercraft, and means for removably securing said standoff bracket to said mounting bracket.

9. The apparatus of claim 8, wherein said arm means includes two pair of arms, each pair extending from one of said pair of pivot shafts to one of said blades.

* * * * *